US009808044B2

(12) United States Patent
Teitz et al.

(10) Patent No.: US 9,808,044 B2
(45) Date of Patent: Nov. 7, 2017

(54) MODIFIABLE AND DECORATIVE FOOTWEAR

(71) Applicants: Deborah S Teitz, Edison, NJ (US); Susan Schlisserman, Highland Park, NJ (US)

(72) Inventors: Deborah S Teitz, Edison, NJ (US); Susan Schlisserman, Highland Park, NJ (US)

( * ) Notice: Subject to any disclaimer, the term of this patent is extended or adjusted under 35 U.S.C. 154(b) by 324 days.

(21) Appl. No.: 14/321,789

(22) Filed: Jul. 1, 2014

(65) Prior Publication Data

US 2015/0020415 A1 Jan. 22, 2015

Related U.S. Application Data

(60) Provisional application No. 61/958,166, filed on Jul. 22, 2013.

(51) Int. Cl.

| | |
|---|---|
| ***A43B 3/10*** | (2006.01) |
| ***A43B 3/12*** | (2006.01) |
| ***A43B 3/18*** | (2006.01) |
| ***A43B 3/24*** | (2006.01) |
| ***A43B 13/00*** | (2006.01) |
| ***A43C 11/00*** | (2006.01) |
| ***A43C 15/00*** | (2006.01) |

(52) U.S. Cl.

CPC ..... *A43B 3/122* (2013.01); *A43B 3/12* (2013.01); *A43B 3/126* (2013.01); *A43B 3/128* (2013.01); *A43B 3/244* (2013.01)

(58) Field of Classification Search

CPC ..... A43B 3/12; A43B 3/122; A43B 3/126; A43B 3/128

USPC ..... 36/100, 103, 11.5, 7.5

See application file for complete search history.

(56) References Cited

U.S. PATENT DOCUMENTS

| | | | | | |
|---|---|---|---|---|---|
| 2,038,151 | A * | 4/1936 | Wernmark | A43B 3/128 | 36/11.5 |
| 2,090,675 | A * | 8/1937 | Hadaway | A43B 3/126 | 12/142 S |
| 2,143,556 | A * | 1/1939 | Hodaly | A43B 3/126 | 36/45 |
| 2,173,702 | A * | 9/1939 | Winkel | A43B 3/12 | 36/11.5 |
| 2,367,092 | A * | 1/1945 | Blotner | A43B 3/122 | 36/11.5 |
| 2,469,708 | A * | 5/1949 | Alexander | A43B 3/122 | 24/713.6 |
| 2,526,940 | A * | 10/1950 | Fello | A43B 3/122 | 36/11.5 |
| 3,121,962 | A * | 2/1964 | Gullo | A43B 3/128 | 36/11.5 |

(Continued)

*Primary Examiner* — Clinton T Ostrup
*Assistant Examiner* — Cameron A Carter
(74) *Attorney, Agent, or Firm* — Henry I. Schanzer, Esq

(57) ABSTRACT

Footwear which can be modified and decorated by a wearer includes a sole through which a set of spaced-apart tunnels are formed which extend the full width of the sole. At least one strip of material is wound through the tunnels and along the opposite sides of the sole and the outer perimeter of the heel region to form loops extending between selected tunnel ends along the right and left sides of the sole and the outer perimeter of the heel region. Ribbons of different colors, shapes and fabrics can be attached to and between the loops enabling a wearer to modify the appearance of the footwear.

21 Claims, 12 Drawing Sheets

(56) References Cited

U.S. PATENT DOCUMENTS

| | | | | |
|---|---|---|---|---|
| 7,347,010 | B2 * | 3/2008 | Yu | A43B 1/0036 36/100 |
| 8,020,319 | B1 * | 9/2011 | Mohaupt | A43B 3/122 36/101 |
| 8,250,780 | B1 * | 8/2012 | Diaz | A43B 3/122 36/101 |
| 8,875,417 | B2 * | 11/2014 | Alberi | A43B 3/244 36/100 |
| 2002/0078600 | A1 * | 6/2002 | Berg | A43B 1/0027 36/101 |
| 2005/0055844 | A1 * | 3/2005 | Yu | A43B 1/0036 36/19 R |
| 2005/0132616 | A1 * | 6/2005 | Yu | A43B 1/0036 36/100 |
| 2005/0257399 | A1 * | 11/2005 | Yu | A43B 1/0036 36/11.5 |
| 2007/0051017 | A1 * | 3/2007 | McClaskie | A43B 13/16 36/11.5 |
| 2007/0245592 | A1 * | 10/2007 | Yamaguchi | A43B 3/108 36/11.5 |
| 2012/0079738 | A1 * | 4/2012 | Alberi | A43B 3/122 36/11.5 |

* cited by examiner

MODIFIABLE AND DECORATIVE FOOTWEAR

This application claims priority based on a provisional application titled Modifiable and Decorative Footwear bearing Ser. No. 61/958,166 filed on Jul. 22, 2013 whose teachings are incorporated herein by reference.

BACKGROUND OF THE INVENTION

This invention relates to footwear and more particularly to footwear which is modifiable by a user and whose appearance can be readily altered.

It is desirable to have footwear which is comfortable and stylish. It is also desirable to have footwear whose appearance can be changed to fit different occasions as well as the mood or preference of its user or wearer.

SUMMARY OF THE INVENTION

In accordance with the invention, modifiable footwear embodying the invention include a sole, shaped to conform generally to the foot of a wearer, having top and bottom surfaces generally parallel to each other. The width of the sole extends between a right side and a left side and the length of the sole extends between a heel region and a toe region. Spaced apart tunnels are formed between the top and bottom surfaces of the sole which extend across the full width of the sole. The tunnels are generally parallel to each and located perpendicularly to the length of the sole. At least one string/strip of suitably firm material' is wound through and along the tunnels and between the ends of the tunnels along the right side of the sole and along the left side of the sole to form "horizontal" loops/straps along the right and left sides of the sole between the top and bottom surfaces. The strings may also be wound around the outer perimeter of the heel region of the sole to form a heel loop/strap.

In accordance with the invention, ribbons of different colors, shapes and fabrics may be selectively attached between the loops to modify the appearance of the footwear as desired by a user.

The sole can be formed of one layer or of multiple layers firmly ached to each other.

The strings can be adjusted and wound along and around the tunnels to form many different configurations and to secure the foot.

The ribbons can be packaged as part of a kit which includes the footwear.

BRIEF DESCRIPTION OF THE DRAWINGS

In the accompanying drawings, which are not drawn to scale, like reference characters denote like components.

DETAILED DESCRIPTION OF THE DRAWINGS

Figure 1:
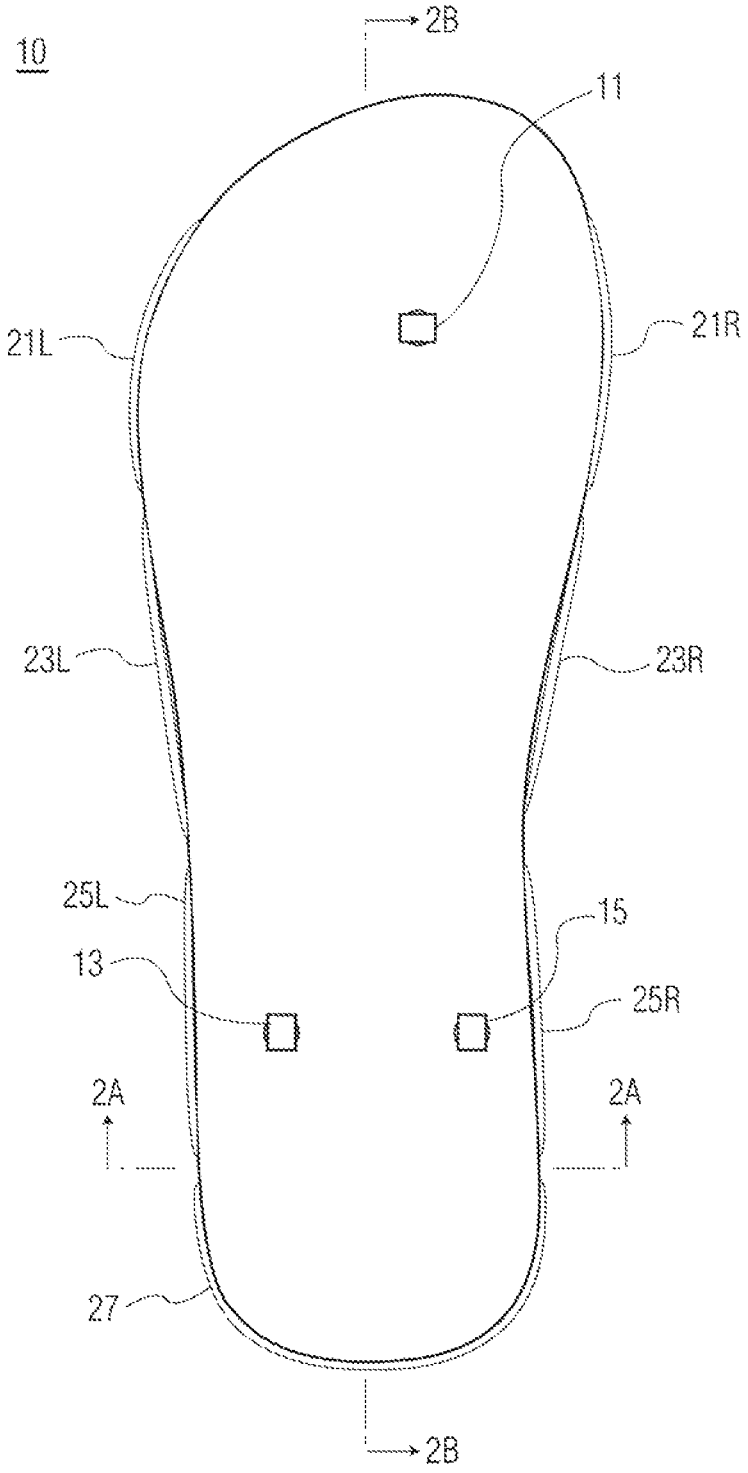
FIG. 1 is a top view of footwear embodying the invention.

Referring to the figures, there is shown footwear 10 which may be readily modified by a user. Referring to FIG. 1, the footwear 10 is shown for the left foot; but it should be realized that the discussion and explanation below are equally applicable to footwear for the right foot. Footwear 10 includes 3 loops (or plugs) 11, 13 and 15 which extend from the underside of the footwear to the topside and which for ease of description will be referred to as vertical loops. The use of these vertical loops 11, 13 and 15 is known. These vertical loops are generally used in a known manner to enable straps to be attached and to hold the foot of the wearer. The footwear embodying the invention may include none or any number of vertical loops.

Footwear (also termed "sandals") 10 embodying the invention defines over known footwear in that it includes horizontal retaining loops (21L, 23L, 25L, 21R, 23R, 25R and 27) extending along the sides of the footwear, as shown in the figures. The horizontal loops may also be referred to as "side straps" or "bands". The loops formed in accordance with the invention are referred to as "horizontal" loops since they extend in a horizontal plane along the outer periphery or perimeter of the sole, in the embodiments shown in the accompanying figures, the horizontal retaining loops are formed by winding a string or cord or leather strip (e.g., 301, 302, 303) through tunnels (e.g., 41, 43, 45, 47) extending across the width of the sole of the footwear between the top layer 101 and the bottom layer 102 of the footwear. The use of string, cord or leather to make the loops has been indicated. However any other suitable flexible material or substance of sufficient strength and durability (e.g., plastic strips) can be used instead.

Figure 5:
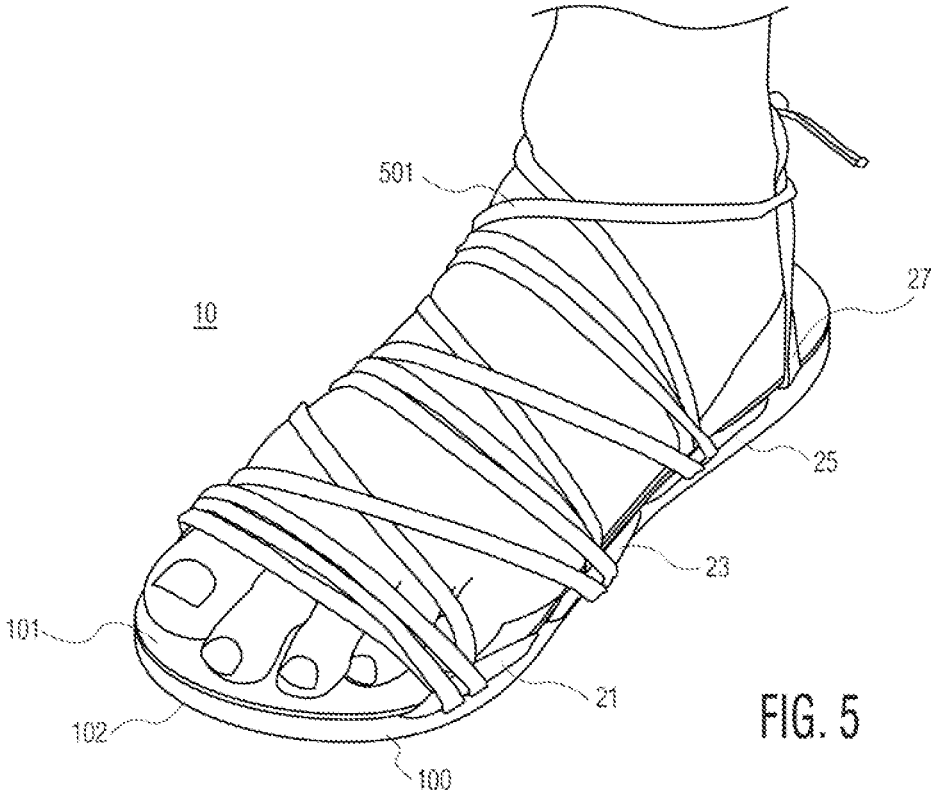
FIGS. 5 and 6 illustrate the foot of user mounted on footwear embodying the invention with ribbons modifying the footwear also in accordance with the invention.
Figure 6:
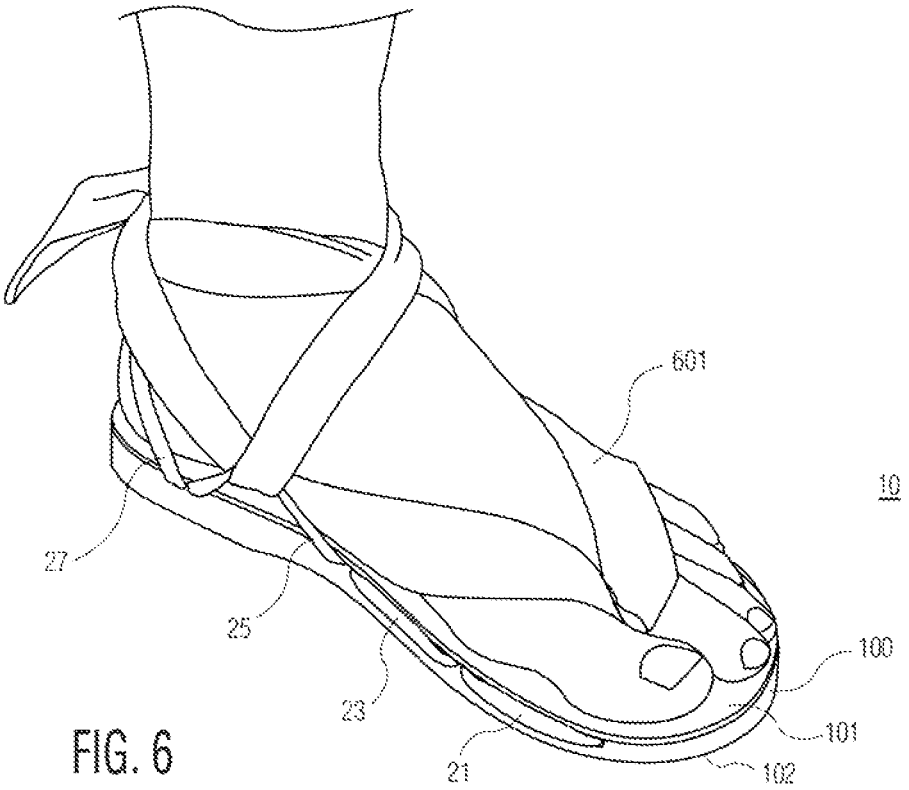

As shown in FIGS. 5 and 6, the horizontal loops enable a user to tie a variety of different ribbons to, through and around the horizontal loops to give the footwear different appearances and to more securely attach the footwear to the foot of the wearer.

Figure 2:
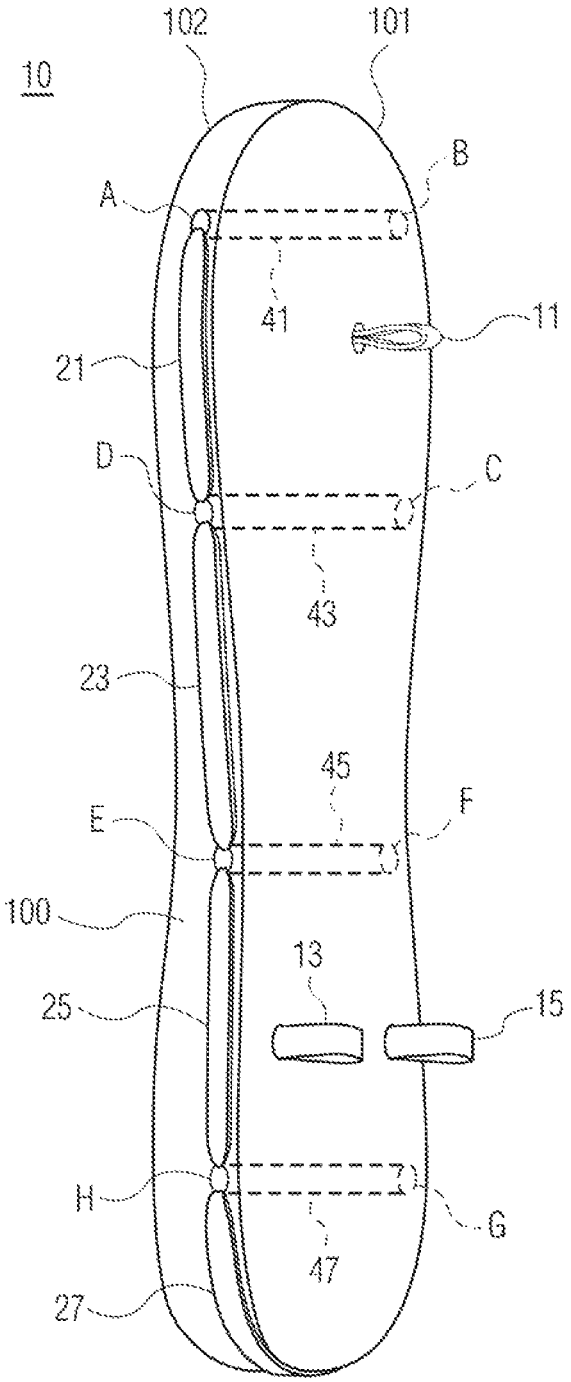
FIG. 2 is a partial isometric view of footwear embodying the invention showing tunnels/grooves (with dashed lines) extending across the sole of the footwear.
Figure 2A:
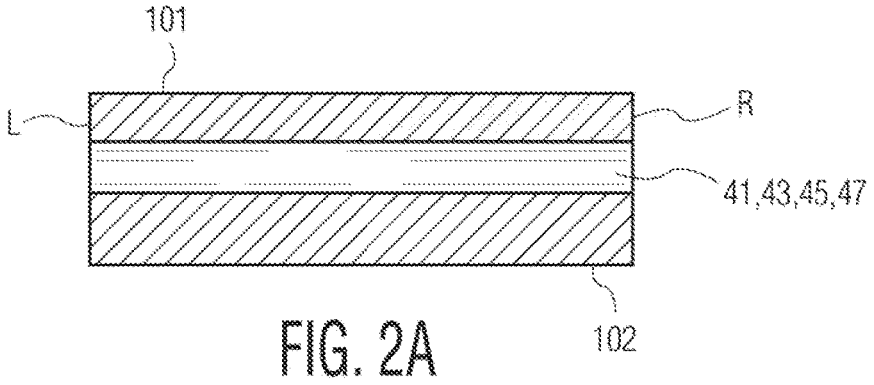
FIG. 2A is an idealized cross sectional drawing showing tunnels extending across the full width of the footwear from the left side (L) to the right side (R)
Figure 2B:
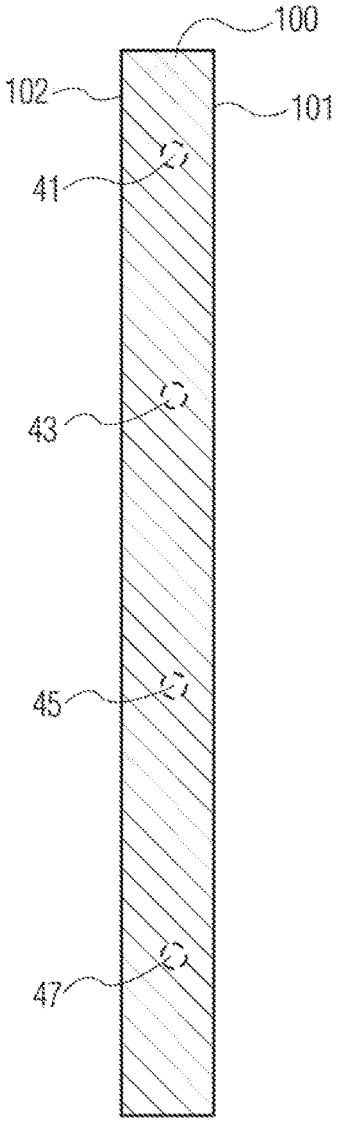
FIG. 2B is an idealized cross sectional drawing showing tunnels disposed along the length of the footwear between the heel region (bottom) and the toe region (top)

Referring to FIGS. 2, 2A, 2B and 2C, there is shown a number of spaced apart tunnels 41, 43, 45 and 47 extending across the full width of the footwear 10. In FIGS. 2, 2A, and 2B the sole 100 (which is made to conform to the shape of a foot) is shown to be formed of a single relatively thick layer. The tunnels (which may also be referred to as grooves or vias) are formed through the center of the sole between the top surface 101 and the bottom surface 102 of the sole. Tunnel 41 has ends designated as A and B; Tunnel 43 has ends designated as C and D; Tunnel 45 has ends designated as E and F; and Tunnel 47 has ends designated as G and H.

Figure 2C:
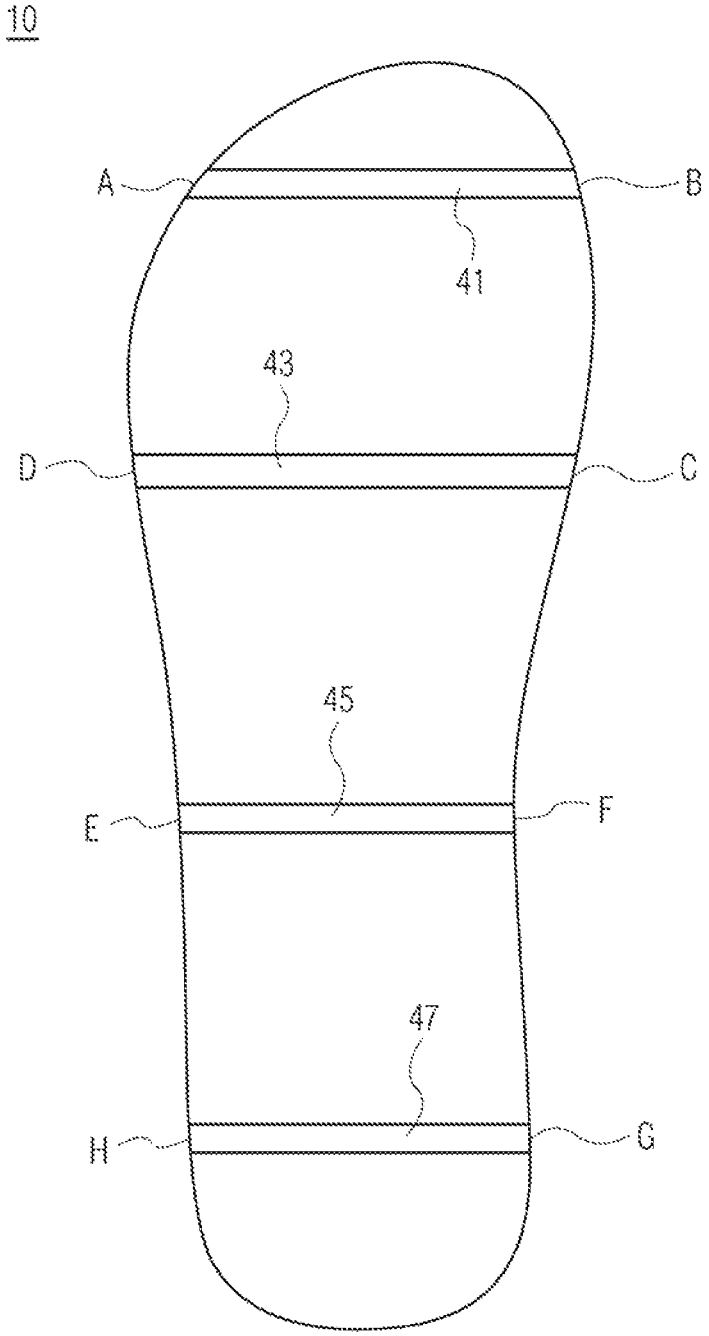
FIG. 2C is an idealized and simplified top view of the footwear embodying the invention with the top layer of the sole removed prior to the insertion of any loop forming string.

FIG. 2A is a cross section of the footwear 10 taken across a tunnel region and is intended to illustrate that each tunnel, or via, is formed across the entire width of the footwear 10, between the right side (R) and the left side (L) of the footwear and generally midway (centrally) between the top (101) and bottom (102) surfaces of the footwear. FIG. 2B is a cross section of the footwear 10 taken along its length (from heel region to toe region) to illustrate that tunnels (41, 43, 45, 47) are formed, generally parallel to each other, in a spaced apart relationship along the length of the footwear, generally midway between the top (101) and bottom (102) layers or surfaces of the sole. FIG. 2C is a top view showing the spacing of the tunnels or grooves along the length of the sole. The showing of 4 tunnels is for purpose of illustration and there may be more or less than 4 tunnels. The tunnels may be formed by drilling the sole or punching or any other suitable manufacturing process. The thickness of the sole may vary over a wide range so long as the thickness is sufficient to enable the formation of tunnels which are wide enough to accommodate the strands of strings that pass or crisscross through the tunnels.

Figure 2D:
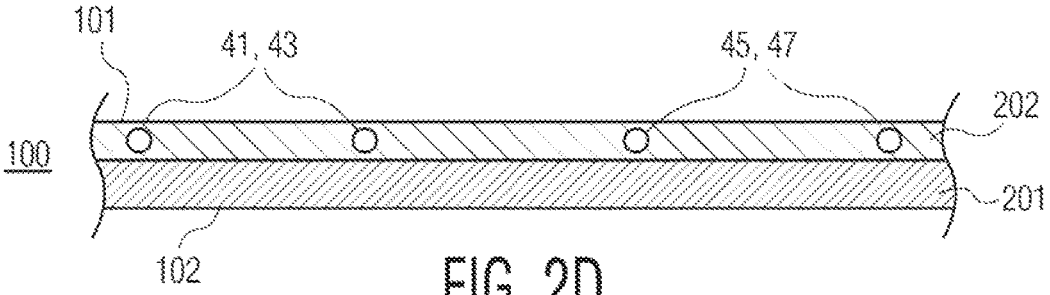
FIG. 2D is an idealized cross sectional drawing of the footwear embodying the invention showing a sole with two layers and tunnels disposed within the top layer.

FIG. 20 is a cross sectional diagram intended to show that the sole 100 may be formed with two layers (201, 202) firmly attached (glued or cemented) to each other. In FIG. 2D the tunnels are shown to be formed in the upper layer. But they could be also formed between the two layers and even in the bottom layer depending on the relative thicknesses of the two layers.

Figure 2E:
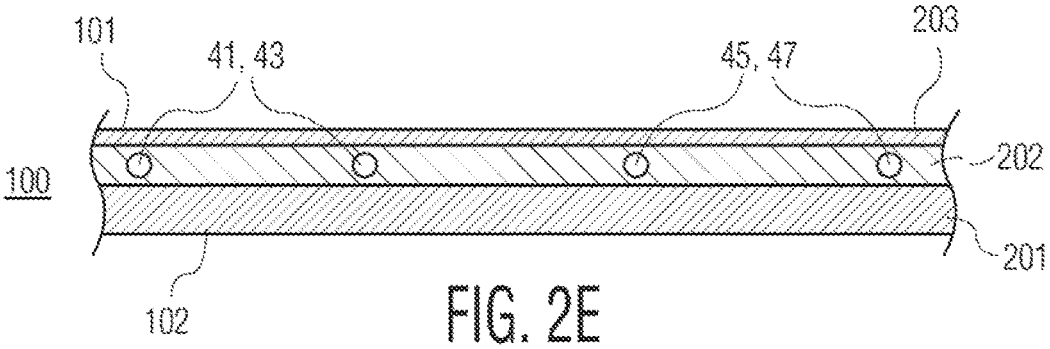
FIG. 2E is an idealized cross sectional drawing of the footwear embodying the invention showing a sole with three layers and tunnels disposed within the middle layer.
Figure 2F:
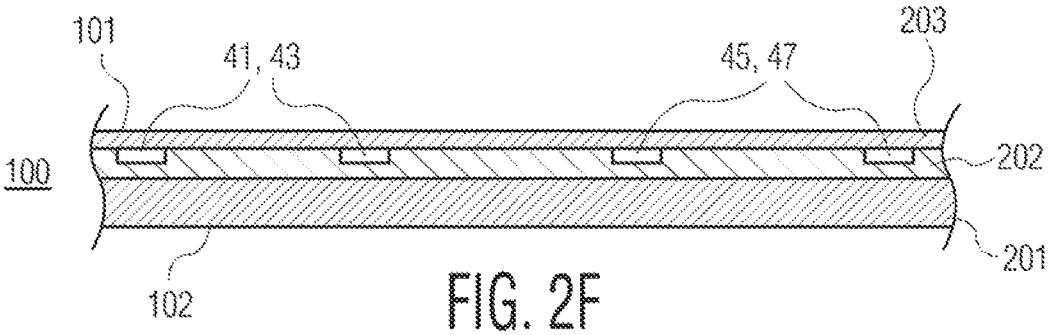
FIG. 2F is an idealized cross sectional drawing of the footwear embodying the invention showing a sole with three layers and tunnels/grooves disposed along the top surface of the middle layer.

FIG. 2E is a cross sectional diagram intended to show that the sole 100 may be formed with three layers (201, 202, 203) firmly attached (glued or cemented) to each other. In FIG. 2E the tunnels are shown to be formed in the middle layer 202. FIG. 2F is a three layered sole, like FIG. 2E, but is intended to show that the tunnels or grooves could be formed between the top surface of the middle layer 202 and the bottom surface of the top layer 203.

Figure 2G:
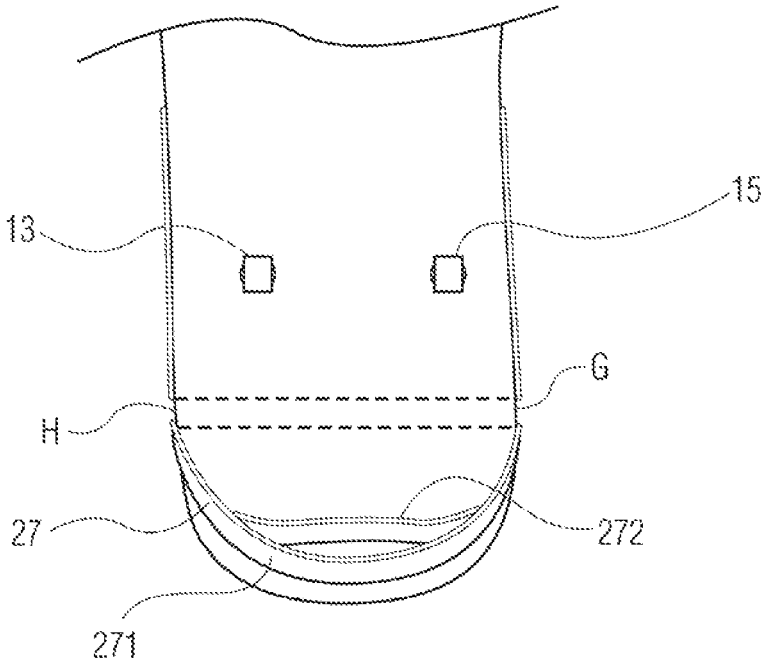
FIG. 2G is an isometric view of the footwear embodying the invention showing a heel strap attached to the back section of the footwear; the heel strap includes an additional string to form another loop.

FIG. 2G shows that a heel loop 271 can be formed with an additional loop 272 attached to heel loop 271 to help secure the heel loop 271 to the heel or ankle of a user, as further describe below.

The structure shown in FIGS. 2, 2A, 2B 2C, 2D, 2E, 2F and 2G enables horizontal loops, straps or bands (21, 23, 25, and 27) to be formed along the sides of the sole. The loops may be formed or strung in many different ways as illustrated in FIGS. 3, 3A 3B and 4. A significant aspect of the invention is that the loops emerge from the side of the footwear and extend along the side of the sole of the footwear. This significant since the foot of a user can lie flat and comfortably along the total top surface of the footwear. That is, footwear embodying the invention require no bumps or uprights going vertically through the sole. However, it is possible to use vertical loops as mentioned above with footwear embodying the invention.

Figure 3:
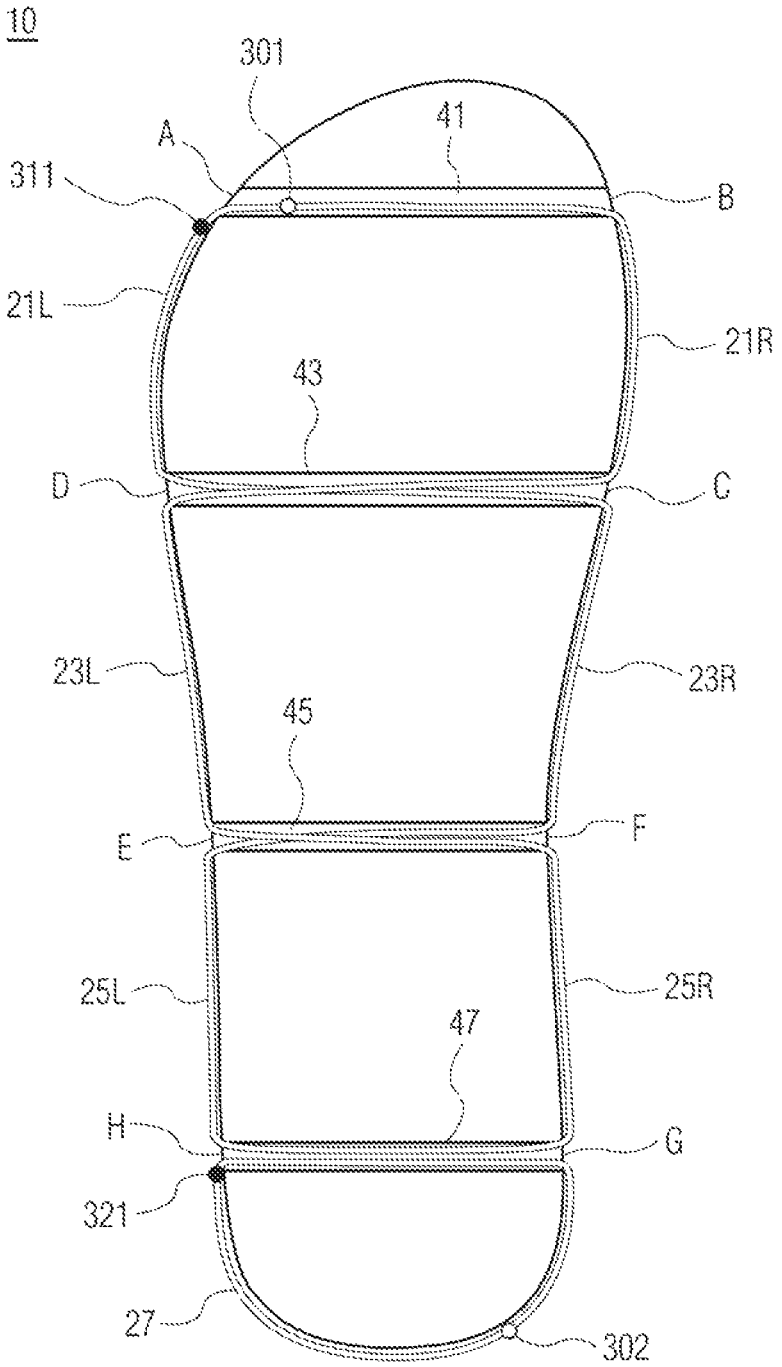
FIG. 3 is a top view of the footwear embodying the invention (with the top layer of the sole removed) showing the winding of strings along the tunnels and the sides of the sole to form loops along the sides of the footwear.

In FIG. 3 there is shown, by way of example, a string/strap 301 which is looped in a figure 8-like configuration beginning at the one end of tunnel 41 designated as A through tunnel 41 to the point designated as B at the end of tunnel 41. Then, the string 301 is wound (looking down at the drawing of FIG. 3) along the right side of the sole of the footwear to the one end of tunnel 43 designated as C and via tunnel 43 to the end of tunnel 43 designated as D. Then, the string 301 is strung along the left side of the sole of the footwear to the one end of tunnel 45 designated as E and via tunnel 45 to the end of tunnel 45 designated as F. Then, the string 301 is strung along the right side of the sole to the one end of tunnel 47 designated as G. The string 301 is then looped back through tunnel 47 to the other end of tunnel 47 designated as H and then along the left hand side of the sole to the end of tunnel 45 designated as E and then through tunnel 45 to the end of tunnel 45 designated as F. The string 301 is then run along the right side of the sole of the footwear to the end of tunnel 43 designated as C and through tunnel 43 to the end of tunnel 43 designated as D. The one end of string 301 (which is arbitrarily referred to as the front end) is then looped from point D along the left side of the footwear to point. A and tied to, or attached, to the other end of string 301 (which is arbitrarily referred to as the back end) to form a closed loop. The attachment may be completed by making a knot 311 or by use of any other attaching mechanism.

In FIG. 3, the portions of the string 301 extending between points: (a) A and form a horizontal loop 21L; (b) B and C form a horizontal loop 21R; (c) D and E form a horizontal loop 23L; (d) C and F form a horizontal loop 23R, (e) F and G form a horizontal loop 25R: and (f) E and H form a horizontal loop 25L As shown in FIGS. 5 and 6, in accordance with the invention, decorative ribbons (501, 601) of different color, shape and fabric may be tied to and/or around the horizontal loops (also referred to as side straps) and to and around the foot of a wearer of the footwear. Note that as configured when the ribbons pull up on a loop (e.g., 25L) the corresponding opposite loop (e.g., 25R) is pulled in (i.e., tightened). In addition, depending on the configuration more than one loop can be tightened.

Figure 3A:
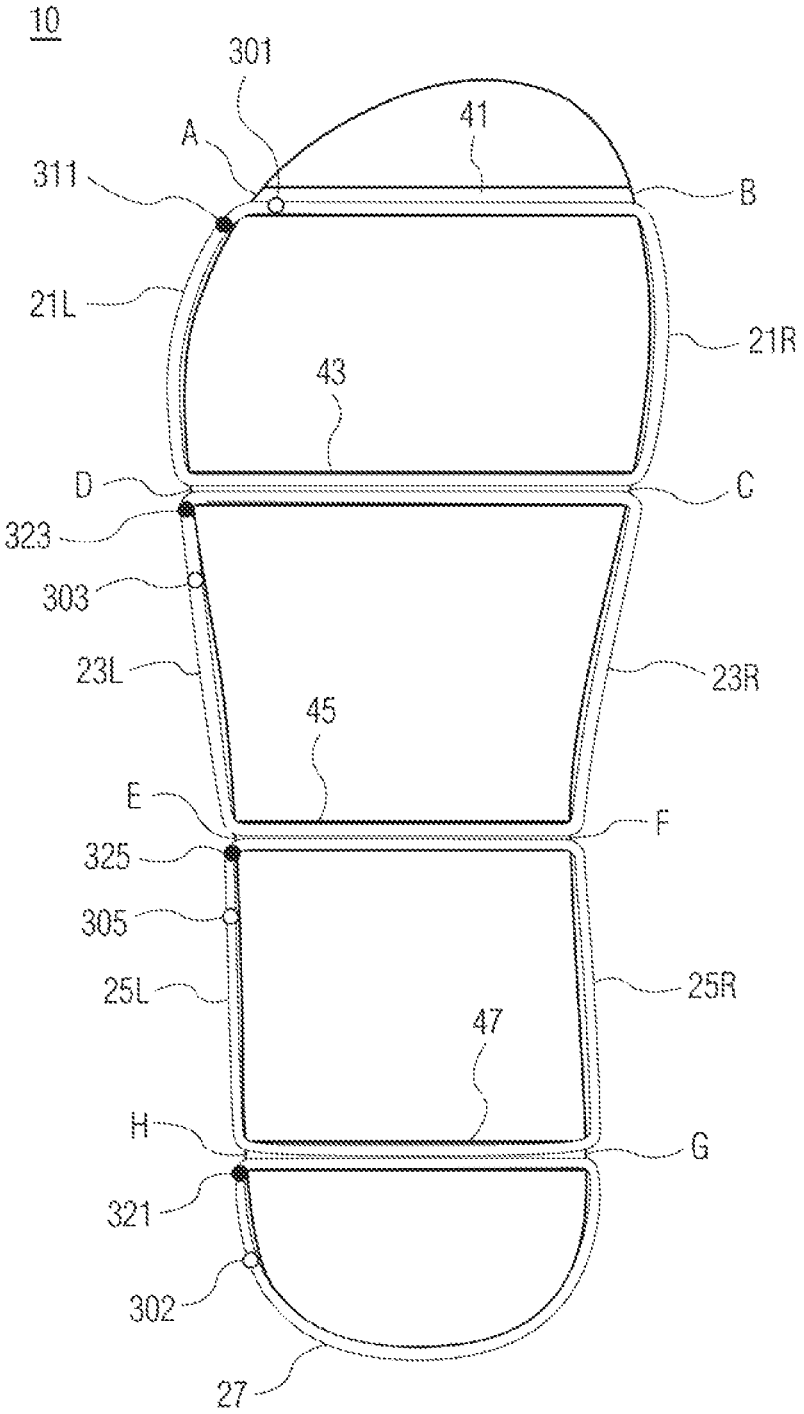
FIG. 3A is another top view of footwear embodying the invention (with the top portion of the sole removed) showing the winding of numerous strings along and around the tunnels to form loops along the sides of the footwear.

In FIGS. 3 and 3A, a second string/strip 302 (in addition to string/strip 301) shown beginning at the one end H of tunnel 47 is passed through tunnel 47 to the end of the tunnel at point G and then along the outer (heel) side of the footwear to form a "heel" loop 27 curving back to point H. The two ends of string 302 are attached to each other at point 321 located at or near an end of tunnel 47. Loop 27 is formed as a separate heel strap 27 because it was found to be useful in securing the footwear to the heel of the wearer and to decorate the back of the foot and ankle. The rear heel portion of loop 27 may include a further internal loop 272 as shown in FIG. 2G.

In FIG. 3A four (4) separate strings (301, 302, 303, 305) are wound around the tunnels 41, 43, 45, and 47, to form: (a) side straps 21L, 23L and 25L along the left hand side of the footwear; (b) side straps 21R, 23R and 25R along the right hand side of the footwear; and (c) heel strap 271. The two ends of each string are attached together (string 301 at 311, string 303 at 323, string 305 at 325, and string 302 at 321).

Figure 3B:
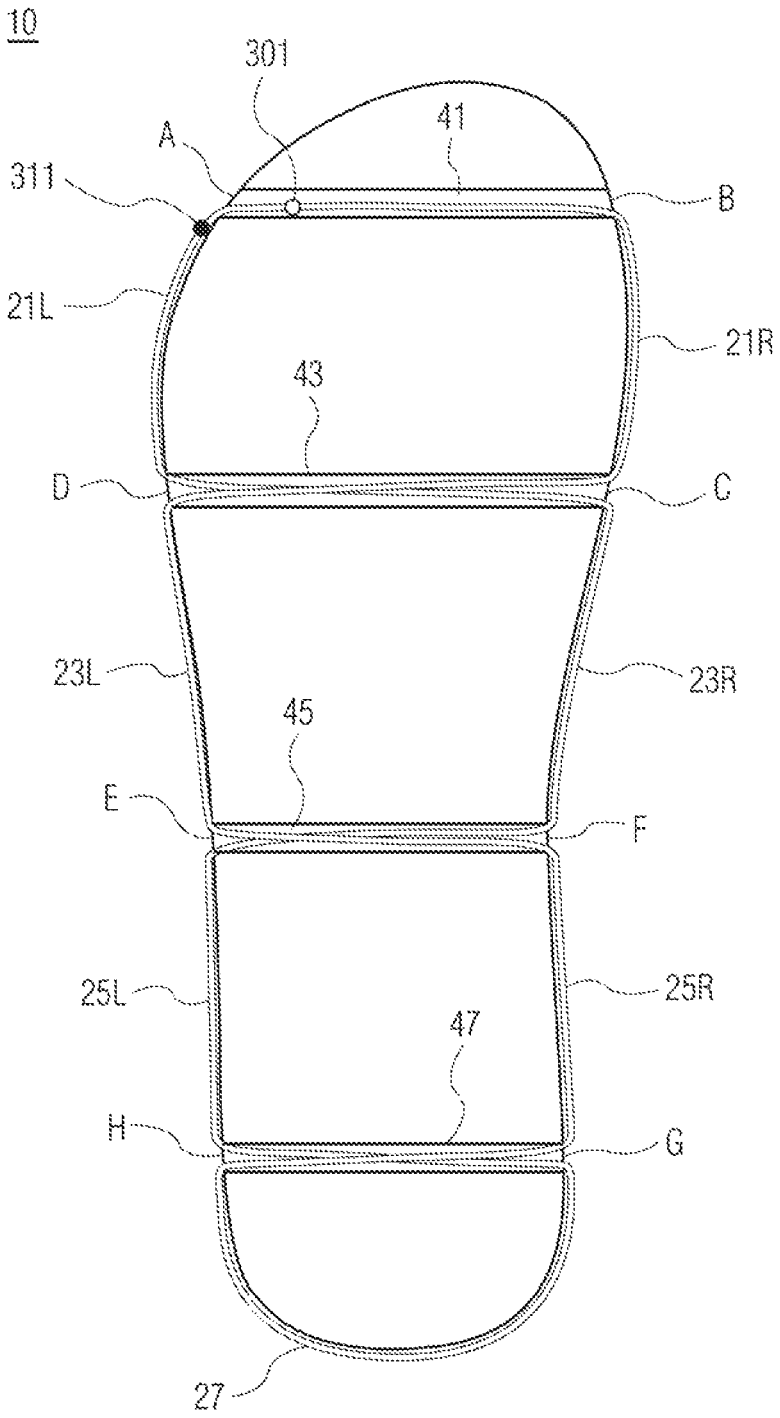
FIG. 3B; is another top view of footwear embodying the invention (with the top portion of the sole removed) showing the winding of a single string along the tunnels and the sides of the sole to form loops along the sides of the footwear

In FIG. 3B a single string 301 is wound around the tunnels for the full extent of the footwear to form all the side straps (21L, 23L, 25L, 21R, 23R, 25R) and the heel strap 27.

Figure 4:
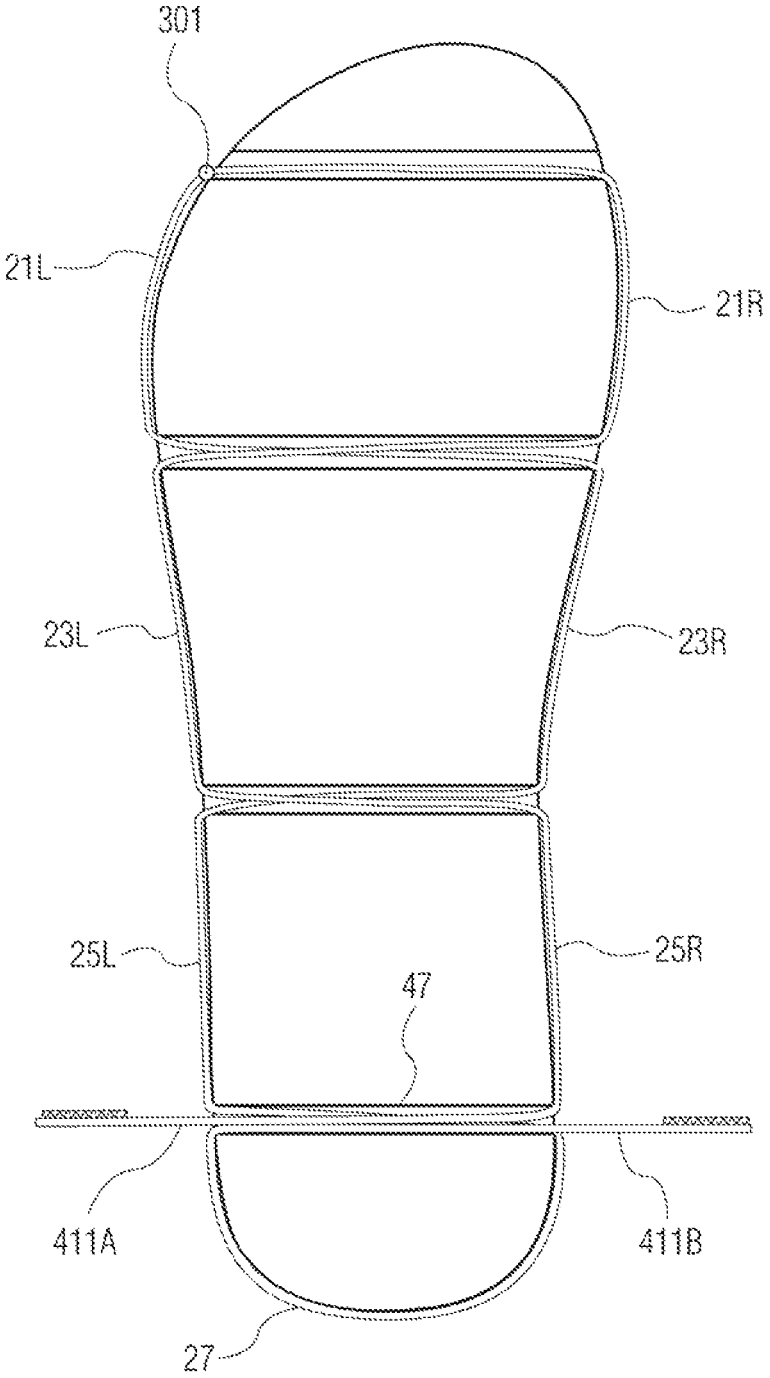
FIG. 4 is another top view of footwear embodying the invention (with the top layer of the sole removed) showing the winding of a single string along the tunnels and the sides of the sole to form loops along the sides of the footwear and an optional rear and/or ankle strap.

In FIG. 4 a single strip 301 is wound around all the tunnels and along all the sides and around the back of the heel with the two ends of the strip 411A and 411B exiting from tunnel 47 in opposite directions. The two ends (411A, 411B) can be pulled to tighten the loops. The two ends can also extend above the ankle of the wearer (user) to provide additional attachment. This demonstrates the versatility and modifiability of the structure. Note that the ends (411A, 411B) of the string/strip 301 can include a strip of Velcro (or any other suitable attaching means) to enable the two ends of string/strip 301 to be attached easily.

FIGS. 5 and 6 illustrate the foot of a user wearing footwear with ribbons (501, 601) embodying the invention. Ribbons (501, 601) may be of different color, shape and fabric. As shown, the ribbons can be wound around the loops or side straps to form many different configurations to modify and alter the appearance of the footwear, as desired by a wearer. In addition to selectively altering or modifying the appearance of the footwear, the ribbons by pulling on the loops function to tighten and secure the loops and also to tighten and secure the footwear to the foot of the wearer. Clearly, footwear is provided whose appearance can be easily and repeatedly modified by the wearer.

In accordance with the invention kits may be formed which include right and left shaped soles (with the strips pre-inserted) and an assortment of ribbons. The strips may also be of different colors and materials. Likewise, the ribbons may be of different colors, shapes and fabrics. The strips may be pre-inserted and wound around the tunnels and along the side or left to the user.

What is claimed is:

1. Modifiable footwear comprising:

a sole shaped to conform generally to a foot of a wearer; said sole having: (a) a predetermined thickness with top and bottom surfaces generally parallel to each other; (b) a width extending between a right side and a left side; and (c) a length extending between a heel region and a toe region;

N spaced apart tunnels, where N is an integer greater than one; said N tunnels formed between the top and bottom surfaces of the sole and running generally parallel to each other in a generally perpendicular direction to the length of the footwear; said N tunnels extending across the full width of the sole with ends along the right and left sides of the sole; and a set of horizontal loops for enabling lacing material to be wrapped around and through said loops and around the foot of a wearer, selected ones of said loops extending horizontally along the left side and along the right side of the footwear; each loop along the right side of the footwear having a paired corresponding loop along the left side of the footwear, each loop and its corresponding paired loop being formed by winding the same strip of material between the same two tunnels and along opposite sides of the footwear between the same two tunnels wherein each loop and its paired corresponding loop are formed with the same strip of selected material; said loops formed by at least one strip of material wound to have one or more closed configurations and solely in a horizontal plane within and through the tunnels and along the right and left sides of the sole and an outer perimeter of the heel region to form said horizontal loops extending between selected tunnel ends along the right and left sides of the sole and the outer perimeter of the heel region, said horizontal loops extending exteriorly to the left and right sides of the sole between said top and bottom surfaces of said sole and in a parallel horizontal direction with the sides.

2. The modifiable footwear as claimed in claim 1 wherein a single strip of material is wound in a crisscross pattern through all the tunnels and around the outer perimeter of the heel region to form loops along the right side of the sole and corresponding loops on the left side of the sole and a heel loop.

3. The modifiable footwear as claimed in claim 1 wherein strips of material are wound through paired tunnels to form loops on the right side of the sole and corresponding loops on the left side of the sole; and a separate strip of material is wound through a tunnel and around the outer perimeter of the heel to form a heel loop.

4. The modifiable footwear as claimed in claim 1 wherein the strip of material is wound such that pulling on a loop located on one side of the sole causes a corresponding loop on the other side of the sole to be tightened.

5. The modifiable footwear as claimed in claim 1 wherein a strip of material is wound through all the tunnels and around the outer perimeter of the heel region to form multiple loops along the right and left sides of the sole and around the heel region and wherein pulling on any one of the loops tends to tighten the other loops.

6. The modifiable footwear as claimed in claim 1 further including a ribbon selectively attached by a wearer between selected loops to alter the appearance of the footwear as desired by the wearer and to further secure the footwear to the foot of the wearer.

7. The modifiable footwear as claimed in claim 1 further including a ribbon selectively attached by a wearer to and through selected ones of the side loops and the heel loop to modify an appearance of the footwear as desired by the wearer and to further secure the footwear to the foot of the wearer.

8. The modifiable footwear as claimed in claim 1, wherein the loops are formed to enable ribbons of different colors, shapes and fabrics to be selectively attached between the loops to give a desired appearance to the footwear by a user and to further secure the footwear to the foot of a wearer.

9. The modifiable footwear as claimed in claim 1 wherein the sole is formed of one layer of material of predetermined thickness.

10. The modifiable footwear as claimed in claim 1 wherein the sole is formed of at least two layers of material.

11. The modifiable footwear as claimed in claim 1 wherein the sole is formed of multiple layers of material securely attached to each other and wherein the tunnels are formed midway between the top and bottom surfaces of the sole.

12. The modifiable footwear as claimed in claim 1, further including a set of selected ribbons selectively attachable to selected loops to give a desired appearance to the footwear by the wearer and to further secure the footwear to the foot of the wearer.

13. Modifiable footwear comprising:

a sole shaped to conform generally to a foot of a wearer; said sole having: (a) top and bottom surfaces, generally parallel to each other, spaced apart by a predetermined thickness; (b) a width extending between a right side and a left side; and (c) a length extending between a heel region and a toe region;

at least two spaced apart tunnels running generally parallel to each other extending across the full width of the sole between the right side and the left side; said tunnels being formed between the top and bottom surfaces of the sole; and permanent and fixed horizontal loops formed along the exterior of the sole and following its contour for enabling selected ribbons to be wound around and through the loops and the foot of a wearer including: (a) a first horizontal loop formed by extending a strip of selected material along the exterior right side of the sole and between two selected spaced apart tunnels and positioned between the top and bottom surfaces of the sole; and (b) a second horizontal loop, opposite the first loop, formed by extending said strip of said selected material through said two selected spaced apart tunnels and along the exterior left side of the sole between said two selected spaced apart tunnels and positioned between the top and bottom surfaces, said first and second horizontal loops are paired and extend exteriorly to the left and right sides of the sole between said top and bottom surfaces of said sole wherein said first and second loops are formed with the same strip of selected material and in a parallel horizontal direction with the sides; said horizontal loops enabling selected ribbons to be wound around and through the loops and the foot of a wearer.

14. The modifiable footwear as claimed in claim 13 wherein a strip of said selected material is wound through a tunnel and around an outer perimeter of the heel region to form a third loop.

15. The modifiable footwear as claimed in claim 14 further including a ribbon selectively attached by a wearer to and through selected ones of the first, second and third loops to give a desired appearance to the footwear by the wearer and to further secure the footwear to the foot of the wearer.

16. The modifiable footwear as claimed in claim 14 wherein the heel loop includes an additional internal loop for facilitating the attachment of a ribbon to the heel loop.

17. The modifiable footwear as claimed in claim 13 wherein the strip of material is wound such that pulling on one of the first and second loops causes a corresponding tightening in the other one of the first and second loops.

18. The modifiable footwear as claimed in claim 13 wherein a strip of material is wound through all the tunnels and around the outer perimeter of the heel region to form multiple paired loops along the right and left sides of the sole and around the heel region and wherein pulling on any one of the paired loops tends to tighten the corresponding paired loop.

19. The modifiable footwear as claimed in claim 13, wherein the loops are formed to enable ribbons of different colors, shapes and fabrics to be selectively attached between the loops to give a desired appearance to the footwear by a user and to further secure the footwear to the foot of a wearer.

20. The modifiable footwear as claimed in claim 13 wherein the strip of material includes securing means at the tip ends of the strip of material for securing such ends.

21. A modifiable footwear kit including:

a sole shaped to conform generally to a foot of a wearer; said sole having: (a) a predetermined thickness with top and bottom surfaces generally parallel to each other; (b) a width extending between a right side and a left side; and (c) a length extending between a heel region and a toe region;

N spaced apart tunnels, where N is an integer greater than one; said N tunnels formed between the top and bottom surfaces of the sole and running generally parallel to each other in a generally perpendicular direction to the length of the footwear; said N tunnels extending across the full width of the sole with ends along the right and left sides of the sole;

at least one strip of material wound through the tunnels and along the right and left sides of the sole and an outer perimeter of the heel region to form horizontal loops extending in the horizontal direction between selected tunnel ends along the right and left sides of the sole and the outer perimeter of the heel region; said horizontal loops extending exteriorly to the left and right sides of the sole between said top and bottom surfaces of said sole and in a parallel horizontal direction with the sides;

selected ones of said loops extending horizontally along the left side and along the right side of the sole; each loop along the right side of the sole having a corresponding loop along the left side of the sole, each loop and its corresponding loop being formed between the same two tunnels the same strip of selected material; said loops along the sides of the sole being paired and following the contour of the sole; and a selection of ribbons of different colors, shapes and fabrics which can be selectively wound around and through said loops and around the foot of a wearer for securing the footwear to the foot of a user.

* * * * *